US005289956A

United States Patent [19]

Petrou

[11] Patent Number: 5,289,956

[45] Date of Patent: Mar. 1, 1994

[54] ROD COUPLING CONSTRUCTION FOR GARMENT HANGERS

[76] Inventor: Nicolean Petrou, 1531 W. Tadmar Ave., Anaheim, Calif. 92802

[21] Appl. No.: 12,868

[22] Filed: Feb. 3, 1993

[51] Int. Cl.[5] ..... A47G 25/48; A47G 25/18

[52] U.S. Cl. ..... 223/85; 223/96; 223/88

[58] Field of Search ..... 223/96, 95, 91, 85, 223/88, 93, 92; 206/278, 298; 211/105.1, 106; 248/251, 221.3; 403/353, 375; D6/315, 323, 328, 326

[56] References Cited

U.S. PATENT DOCUMENTS

| | | | |
|---|---|---|---|
| 2,123,518 | 7/1938 | Yankovitch | 223/91 |
| 2,372,458 | 3/1945 | Tewell . | |
| 2,486,749 | 11/1949 | Marks | 223/91 |
| 3,537,626 | 11/1970 | Wright . | |
| 3,730,406 | 5/1973 | Sullivan . | |
| 3,986,318 | 10/1976 | McConnell | 403/353 |
| 4,446,996 | 5/1984 | Garrison . | |
| 4,638,930 | 1/1987 | Blanchard . | |
| 4,793,531 | 12/1988 | Blanchard et al. . | |
| 5,052,600 | 10/1991 | Elchisak et al. . | |

*Primary Examiner*—Clifford D. Crowder
*Assistant Examiner*—Bibhu Mohanty
*Attorney, Agent, or Firm*—Blum Kaplan

[57] ABSTRACT

A garment hanger adapted to support an elongated rod. The garment hanger includes an elongated body having two ends and a supporting portion therebetween. The ends of the body extend downwardly to form a pair of spaced legs each having a rod receiving portion. Each rod receiving portion is defined by a bottom wall, a back wall joined to the bottom wall and forming a part of the body, a side wall and a front wall joined to the bottom wall and side wall and spaced a predetermined distance from the back wall to define an initial rod receiving pocket. A secondary rod receiving pocket is defined below the initial rod receiving pocket and is offset therefrom. The width of the initial and secondary rod receiving pockets are essentially the same as the diameter of the rod to permit the rod to be locked in the secondary rod receiving pocket.

5 Claims, 2 Drawing Sheets

ROD COUPLING CONSTRUCTION FOR GARMENT HANGERS

BACKGROUND OF THE INVENTION

The present invention is directed to a plastic garment hanger having means for supporting a clip-holding metal rod and, in particular, to an improved rod coupling construction for plastic garment hangers.

Plastic garment hangers having a body portion which supports a metal rod having slidable clips thereon are well-known in the art. Such garment hangers include a plastic body portion having a centrally located hook for suspending the hanger from a support rod. Such hangers further include two depending legs which support a laterally extending metal rod on which one or more plastic or metal clips are coupled. The clips are used to capture and releaseably hold garments or other articles between the jaws of the clips.

In one prior art construction, the metal rod is fixed in lateral slots formed in the body of the garment hanger during the molding process. The rod is actually inserted in the mold and the legs of the hanger are molded around the rod to make an essentially permanent coupling. In another prior art construction, the rod is inserted in lateral side openings in the hanger legs after molding of the hanger.

An attempt to improve on the construction of a rod receiving garment hanger is found in U.S. Pat. No. 4,638,930 which issued on Jan. 27, 1987. This patent discloses a garment hanger with depending legs each having a rod receiving pocket defined by a curved lower wall and a downwardly depending resilient tongue which locks the rod in the pocket as the tongue presses downwardly on the rod. If the molding tolerances are not correct, the locking tongue in such construction can fail to operate properly to lock the rod in the pocket.

U.S. Pat. No. 5,052,600 which issued on Oct. 1, 1991 discloses another such improved construction which uses an upstanding resilient tongue and an indent to hold the bar in position. In some cases, the tongue may break during manufacture or use.

Accordingly, it is desired to provide an improved rod coupling construction for garment hangers which overcomes the disadvantages noted above with respect to the prior art while permitting the rod to be inserted after molding of the garment hanger.

SUMMARY OF THE INVENTION

Generally speaking, in accordance with the present invention, a garment hanger adapted to support an elongated rod is provided. The garment hanger includes an elongated body having two ends and a supporting portion therebetween. The ends of the body extend downwardly to form a pair of spaced legs each having a rod receiving portion. Each rod receiving portion is defined by a bottom wall, a back wall joined to the bottom wall and forming a part of the body, a side wall and a front wall joined to the bottom wall and side wall and spaced a predetermined distance from the back wall to define an initial rod receiving pocket. A secondary rod receiving pocket is defined below the initial rod receiving pocket and is offset therefrom. The width of the initial and secondary rod receiving pockets are essentially the same as the diameter of the rod to permit the rod to be locked in the secondary rod receiving pocket.

In a preferred embodiment, the rod receiving portion includes a rod reception area above the initial rod receiving pocket which positions the rod for movement into the initial rod receiving pocket, for subsequent movement into the secondary rod receiving pocket.

Accordingly, it is an object of the present invention to provide an improved rod coupling construction for garment hangers.

Another object of the present invention is to provide a plastic garment hanger having two depending legs on which a metal rod can be supported after molding of the hanger.

A further object of the present invention is to provide specially designed rod receiving slots in the legs of a plastic garment hanger which permit a metal rod to be readily inserted therein.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
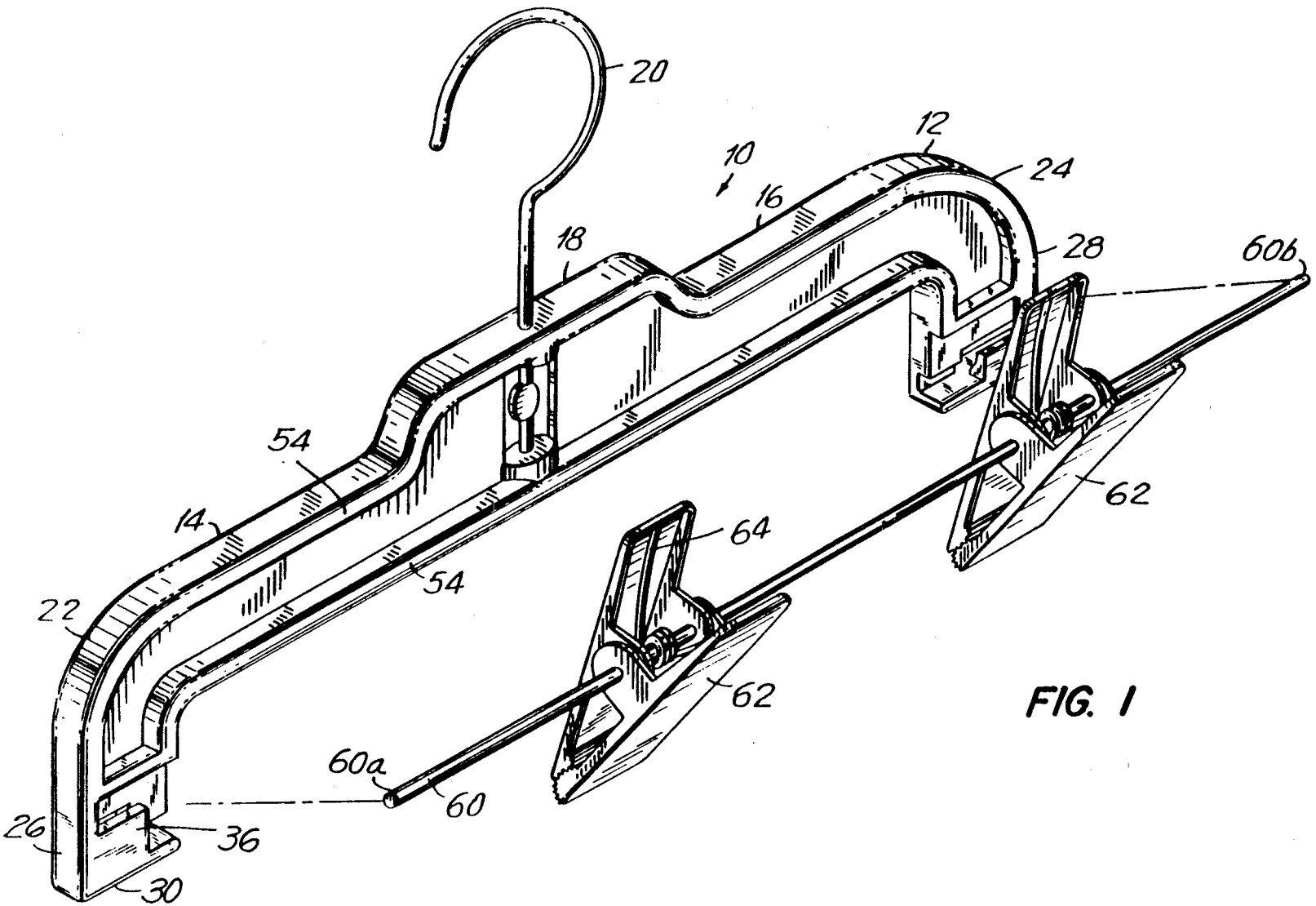
FIG. 1 is a perspective exploded view of a garment hanger having a rod coupling construction in accordance with a preferred embodiment of the present invention.
Figure 2:
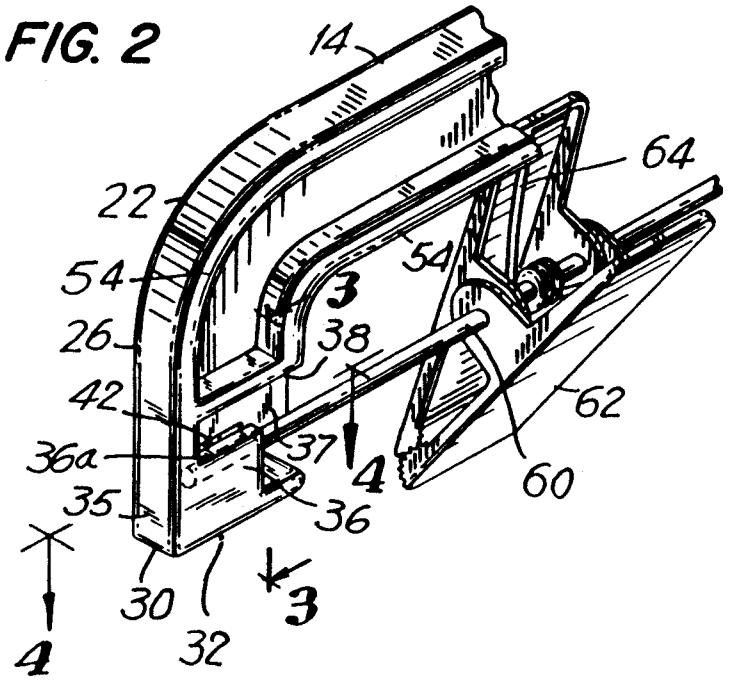
FIG. 2 is a partial perspective view of one of the hanger legs depicted in FIG. 1, shown with the metal rod in an intermediate position during insertion.
Figure 5:
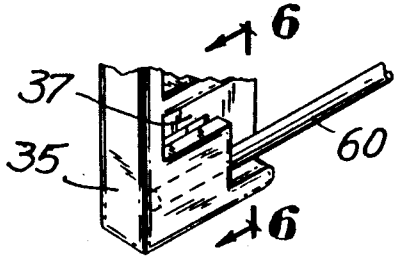
FIG. 5 is a partial perspective view of the hanger leg depicted in FIG. 2 with the rod shown in its final position.

Reference is made to FIGS. 1 through 6 in the present application which depict a garment hanger, generally indicated at 10, and constructed in accordance with a preferred embodiment of the present invention. Hanger 10 includes a body portion 12 preferably molded from a thermoplastic material having arms 14 and 16 which extend respectively outwardly from a centrally located neck portion 18. Neck portion 18 supports a conventional metal hook 20 which is used to support garment hanger 10 from a support rod, hook or the like. Hanger 10 preferably includes a reinforcing I-beam construction as depicted and described below.

Each arm 14 and 16 terminates laterally in a respective rounded shoulder 22 and 24 which turns downwardly to a respective first leg 26 and second leg 28. Since both legs 26 and 28 are similarly constructed, only the details of construction of leg 26 will hereinafter be described.

Leg 26 includes a rod receiving portion 30 defined by a bottom wall 32, a back wall 34 joined to bottom wall 32 and forming a part of body 12, a side wall 35 and an upstanding front wall 36 joined to bottom wall 32 and side wall 35. A rod reception area 37 is defined by upper end 36*a* of front wall 36, side wall 35, back wall 34 and lower reinforcing wall 38 of a rib 54 which extends around hanger 10 to form the I-beam construction. Front wall 36 is spaced a predetermined distance from back wall 34 and is laterally offset to provide sufficient clearance for a rod 60 to be pressed therein after leaving rod reception area 37 to define an initial rod receiving pocket 40.

Figures 3, 6:
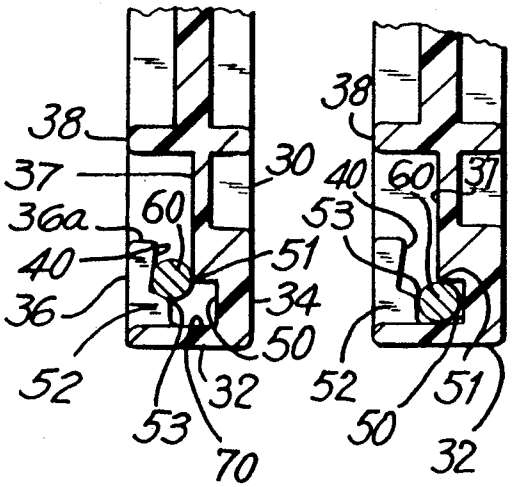
FIG. 3 is an enlarged sectional view taken along line 3—3 of FIG. 2.
FIG. 6 is an enlarged sectional view taken along line 6—6 of FIG. 5.
Figure 4:
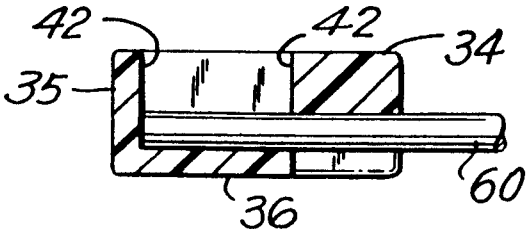
FIG. 4 is an enlarged sectional view taken along line 4—4 of FIG. 2.

Back wall 34 includes an opening 42 therein in alignment with front wall 36. Back wall 34 also includes a recessed portion 50 spaced in the lateral direction from front wall 36 which cooperates with front wall 36 defining a secondary rod receiving pocket 70 to capture rod 60 therein when rod 60 is moved downwardly from initial rod receiving pocket 40 as best depicted in FIG. 6.

The inside surface of front wall 36 includes an enlarged region 52 on the lower end thereof which includes a corner 53 which opposes a corner 51 defined at the upper end of recessed portion 50 by back wall 34. It is noted that secondary pocket 70 is offset with respect to initial pocket 40 as best depicted in FIGS. 3 and 6. It is also noted that the width of initial rod receiving pocket 40, the distance between corners 51 and 53, and the width of secondary rod receiving pocket 70 are substantially the same as the diameter of rod 60. In this fashion, rod 60 is properly and essentially permanently fixed in secondary pocket 70. In one embodiment, the diameter of the metal rod may be 0.115".

As depicted in FIG. 1, rod 60 may include one or more clips 62 slidably received thereon for clamping garments or other objects to hanger 10. Clips 62 may be formed from metal or plastic and may include a spring 64 or other biasing means for holding the jaws of clamp 62 in a closed position.

During manufacture, hanger body 12 is molded separately from rod 60. After molding, hook 20 may be inserted (if not formed with hanger body 12) and appropriately attached to hanger body 12. It is noted that a plastic hook molded with hanger body 12 may also be used. Ends 60*a* and 60*b* of rod 60 (with clips 62 thereon) are then positioned in their respective rod reception area 37 and then moved downwardly into initial rod receiving pocket 40 as depicted in FIG. 3. Additional downward force exerted on rod 60 forces rod 60 to "click" past opposing spaced corners 51 and 53 into secondary pocket 70 defined by cut-out portion 50 and enlarged region 52 of front wall 36. It is recognized that depending on the type of thermoplastic material used to mold hanger body 12, an essentially permanent locking occurs once rod 60 is moved to its final position due to the tolerances referred to above and the irregular path of insertion.

The garment hanger of the present invention is easy to manufacture and simple to assemble. The rod coupling construction on the legs of the garment hanger permit ready insertion of the rod while insuring an appropriate locking of the rod in the pockets.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A garment hanger adapted to support an elongated rod comprising an elongated body having two ends and a supporting portion therebetween, said ends of said body extending downwardly to form a pair of spaced legs each having a rod receiving portion, each said rod receiving portion being defined by a bottom wall, a back wall joined to said bottom wall and forming part of said body, a side wall and a front wall joined to said bottom wall and side wall and spaced a predetermined distance from said back wall to define an initial rod receiving pocket, a secondary rod receiving pocket below said initial rod receiving pocket and offset therefrom, the width of said initial and secondary rod receiving pockets being essentially the same as the diameter of said rod to permit said rod to be locked in said secondary rod receiving pocket, opposing corners being formed intermediate said initial rod receiving pocket and said secondary rod receiving pocket, said opposing corners being spaced a distance essentially equal to the diameter of said rod.

2. The garment hanger as claimed in claim 1, wherein said rod receiving portion includes a rod reception area above said initial rod receiving pocket which positions said rod for movement into said initial rod receiving pocket.

3. The garment hanger as claimed in claim 2, wherein said body includes a rib extending essentially around the periphery thereof, said rib extending across upper side of said rod receiving portion, and further extending across the outer side of each said rod receiving pocket to define said side wall to prevent said rod from being moved laterally beyond the ends of said body.

4. The garment hanger as claimed in claim 1, wherein said rod is moved from said initial rod receiving pocket and forced past said opposing corners to be locked in said secondary rod receiving pocket.

5. A garment hanger adapted to support an elongated rod comprising an elongated body having two ends and a supporting portion therebetween, said ends of said body extending downwardly to form a pair of spaced legs each having a rod receiving portion, each said rod receiving portion being defined by a bottom wall, a back wall joined to said bottom wall and forming part of said body, a side wall and a front wall joined to said bottom wall and side wall and spaced a predetermined distance from said back wall to define an initial rod receiving pocket, a secondary rod receiving pocket below said initial rod receiving pocket and offset therefrom, the width of said initial and secondary rod receiving pockets being essentially the same as the diameter of said rod to permit said rod to be locked in said secondary rod receiving pocket, said back wall having an opening in alignment with said front wall, the inner surface of said front wall including an enlarged region and the inner surface of the back wall having a recessed portion which is laterally offset from said enlarged region to define said secondary rod receiving pocket.

* * * * *